US008692170B2

(12) United States Patent
Parsche

(10) Patent No.: US 8,692,170 B2
(45) Date of Patent: Apr. 8, 2014

(54) LITZ HEATING ANTENNA

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 471 days.

(21) Appl. No.: 12/882,354

(22) Filed: Sep. 15, 2010

(65) Prior Publication Data

US 2012/0061383 A1 Mar. 15, 2012

(51) Int. Cl.
*H05B 6/10* (2006.01)

(52) U.S. Cl.
USPC ..... 219/635

(58) Field of Classification Search
USPC ..... 174/42, 110, 114 R, 119 R, 127, 130, 174/131, 110 R, 113 R, 119 C, 131 R; 57/212, 57/213, 214, 216, 217, 218, 220, 221, 222, 57/223; 219/600, 635, 636; 392/301; 166/57
See application file for complete search history.

(56) References Cited

U.S. PATENT DOCUMENTS

| | | | | |
|---|---|---|---|---|
| 2,371,459 | A | 3/1945 | Mittelmann | |
| 2,606,134 | A * | 8/1952 | Sanders | 156/56 |
| 2,685,930 | A | 8/1954 | Albaugh | |
| 3,497,005 | A | 2/1970 | Pelopsky | |
| 3,848,671 | A | 11/1974 | Kern | |
| 3,954,140 | A | 5/1976 | Hendrick | |
| 3,988,036 | A | 10/1976 | Fisher | |
| 3,991,091 | A | 11/1976 | Driscoll | |
| 4,035,282 | A | 7/1977 | Stuchberry et al. | |
| 4,042,487 | A | 8/1977 | Seguchi | |
| 4,087,781 | A | 5/1978 | Grossi et al. | |
| 4,136,014 | A | 1/1979 | Vermeulen | |

(Continued)

FOREIGN PATENT DOCUMENTS

| | | |
|---|---|---|
| CA | 1199573 A1 | 1/1986 |
| CA | 2678473 | 8/2009 |

(Continued)

OTHER PUBLICATIONS

Butler, R.M. "Theoretical Studies on the Gravity Drainage of Heavy Oil During In-Situ Steam Heating", Can J. Chem Eng, vol. 59, 1981.

(Continued)

*Primary Examiner* — Dana Ross
*Assistant Examiner* — Joseph Iskra
(74) *Attorney, Agent, or Firm* — Allen, Dyer, Doppelt, Milbrath & Gilchrist, P.A.

(57) ABSTRACT

An electromagnetic heating applicator is disclosed. The applicator includes a first strand and a second strand, each of which has an insulated portion, a bare portion, and is made up of at least one wire. The first and second strands are braided, twisted, or both braided and twisted together such that the bare portion of each strand is adjacent to the insulated portion of the other strand. A system and method for heating a geological formation are also disclosed. The system includes an applicator in a bore that extends into a formation, an extraction bore connected to a pump and positioned under the first bore, and transmitting equipment connected to the applicator. The method includes the steps of providing the components of the system, connecting the applicator to RF power transmitting equipment, applying RF power to the applicator using the transmitting equipment, and pumping hydrocarbons out of the extraction bore.

19 Claims, 11 Drawing Sheets

(56) References Cited

U.S. PATENT DOCUMENTS

| | | | | |
|---|---|---|---|---|
| 4,140,179 | A | 2/1979 | Kasevich et al. | |
| 4,140,180 | A | 2/1979 | Bridges et al. | |
| 4,144,935 | A * | 3/1979 | Bridges et al. | 166/248 |
| 4,146,125 | A | 3/1979 | Sanford et al. | |
| 4,196,329 | A | 4/1980 | Rowland et al. | |
| 4,295,880 | A | 10/1981 | Horner | |
| 4,300,219 | A | 11/1981 | Joyal | |
| 4,301,865 | A | 11/1981 | Kasevich et al. | |
| 4,303,021 | A | 12/1981 | Winter et al. | |
| 4,328,324 | A | 5/1982 | Kock | |
| 4,373,581 | A | 2/1983 | Toellner | |
| 4,396,062 | A | 8/1983 | Iskander | |
| 4,404,123 | A | 9/1983 | Chu | |
| 4,410,216 | A | 10/1983 | Allen | |
| 4,425,227 | A | 1/1984 | Smith | |
| 4,449,585 | A | 5/1984 | Bridges et al. | |
| 4,456,065 | A | 6/1984 | Heim et al. | |
| 4,457,365 | A | 7/1984 | Kasevich et al. | |
| 4,470,459 | A | 9/1984 | Copland | |
| 4,485,869 | A | 12/1984 | Sresty | |
| 4,487,257 | A | 12/1984 | Dauphine | |
| 4,508,168 | A | 4/1985 | Heeren | |
| 4,514,305 | A | 4/1985 | Filby | |
| 4,524,827 | A | 6/1985 | Bridges | |
| 4,531,468 | A | 7/1985 | Simon | |
| 4,583,586 | A | 4/1986 | Fujimoto et al. | |
| 4,620,593 | A | 11/1986 | Haagensen | |
| 4,622,496 | A | 11/1986 | Dattili | |
| 4,645,585 | A | 2/1987 | White | |
| 4,678,034 | A | 7/1987 | Eastlund | |
| 4,703,433 | A | 10/1987 | Sharrit | |
| 4,790,375 | A | 12/1988 | Bridges | |
| 4,816,649 | A * | 3/1989 | Eilentroop | 219/549 |
| 4,817,711 | A | 4/1989 | Jeambey | |
| 4,882,984 | A | 11/1989 | Eves, II | |
| 4,892,782 | A | 1/1990 | Fisher et al. | |
| 5,046,559 | A | 9/1991 | Glandt | |
| 5,055,180 | A | 10/1991 | Klaila | |
| 5,065,819 | A | 11/1991 | Kasevich | |
| 5,082,054 | A | 1/1992 | Kiamanesh | |
| 5,136,249 | A | 8/1992 | White | |
| 5,199,488 | A | 4/1993 | Kasevich | |
| 5,233,306 | A | 8/1993 | Misra | |
| 5,236,039 | A | 8/1993 | Edelstein | |
| 5,251,700 | A | 10/1993 | Nelson | |
| 5,293,936 | A | 3/1994 | Bridges | |
| 5,304,767 | A | 4/1994 | McGaffigan | |
| 5,315,561 | A | 5/1994 | Grossi | |
| 5,370,477 | A | 12/1994 | Bunin | |
| 5,378,879 | A | 1/1995 | Monovoukas | |
| 5,506,592 | A | 4/1996 | MacDonald | |
| 5,582,854 | A | 12/1996 | Nosaka | |
| 5,621,844 | A | 4/1997 | Bridges | |
| 5,631,562 | A | 5/1997 | Cram | |
| 5,746,909 | A | 5/1998 | Calta | |
| 5,910,287 | A | 6/1999 | Cassin | |
| 5,923,299 | A | 7/1999 | Brown et al. | |
| 6,045,648 | A | 4/2000 | Palmgren et al. | |
| 6,046,464 | A | 4/2000 | Schetzina | |
| 6,055,213 | A | 4/2000 | Rubbo | |
| 6,063,338 | A | 5/2000 | Pham | |
| 6,066,799 | A * | 5/2000 | Nugent | 174/27 |
| 6,097,262 | A | 8/2000 | Combellack | |
| 6,106,895 | A | 8/2000 | Usuki | |
| 6,112,273 | A | 8/2000 | Kau | |
| 6,184,427 | B1 | 2/2001 | Klepfer | |
| 6,229,603 | B1 | 5/2001 | Coassin | |
| 6,232,114 | B1 | 5/2001 | Coassin | |
| 6,301,088 | B1 | 10/2001 | Nakada | |
| 6,348,679 | B1 | 2/2002 | Ryan et al. | |
| 6,360,819 | B1 | 3/2002 | Vinegar | |
| 6,432,365 | B1 | 8/2002 | Levin | |
| 6,603,309 | B2 | 8/2003 | Forgang | |
| 6,613,678 | B1 | 9/2003 | Sakaguchi | |
| 6,614,059 | B1 | 9/2003 | Tsujimura | |
| 6,649,888 | B2 | 11/2003 | Ryan et al. | |
| 6,712,136 | B2 | 3/2004 | de Rouffignac | |
| 6,808,935 | B2 | 10/2004 | Levin | |
| 6,923,273 | B2 | 8/2005 | Terry | |
| 6,932,155 | B2 | 8/2005 | Vinegar | |
| 6,967,589 | B1 | 11/2005 | Peters | |
| 6,992,630 | B2 | 1/2006 | Parsche | |
| 7,004,251 | B2 * | 2/2006 | Ward et al. | 166/245 |
| 7,046,584 | B2 | 5/2006 | Sorrells | |
| 7,079,081 | B2 | 7/2006 | Parsche et al. | |
| 7,091,460 | B2 | 8/2006 | Kinzer | |
| 7,109,457 | B2 | 9/2006 | Kinzer | |
| 7,115,847 | B2 | 10/2006 | Kinzer | |
| 7,147,057 | B2 | 12/2006 | Steele | |
| 7,172,038 | B2 | 2/2007 | Terry | |
| 7,205,947 | B2 | 4/2007 | Parsche | |
| 7,312,428 | B2 | 12/2007 | Kinzer | |
| 7,322,416 | B2 | 1/2008 | Burris, II | |
| 7,337,980 | B2 | 3/2008 | Schaedel | |
| 7,438,807 | B2 | 10/2008 | Garner et al. | |
| 7,441,597 | B2 | 10/2008 | Kasevich | |
| 7,461,693 | B2 | 12/2008 | Considine et al. | |
| 7,484,561 | B2 | 2/2009 | Bridges | |
| 7,562,708 | B2 | 7/2009 | Cogliandro | |
| 7,623,804 | B2 | 11/2009 | Sone | |
| 2002/0032534 | A1 | 3/2002 | Regier | |
| 2004/0031731 | A1 | 2/2004 | Honeycutt | |
| 2005/0199386 | A1 | 9/2005 | Kinzer | |
| 2005/0274513 | A1 | 12/2005 | Schultz | |
| 2006/0038083 | A1 | 2/2006 | Criswell | |
| 2007/0108202 | A1 | 5/2007 | Kinzer | |
| 2007/0131591 | A1 | 6/2007 | Pringle | |
| 2007/0137852 | A1 | 6/2007 | Considine et al. | |
| 2007/0137858 | A1 | 6/2007 | Considine et al. | |
| 2007/0187089 | A1 | 8/2007 | Bridges | |
| 2007/0261844 | A1 | 11/2007 | Cogliandro et al. | |
| 2008/0073079 | A1 | 3/2008 | Tranquilla | |
| 2008/0143330 | A1 | 6/2008 | Madio | |
| 2009/0009410 | A1 | 1/2009 | Dolgin | |
| 2009/0050318 | A1 | 2/2009 | Kasevich | |
| 2009/0242196 | A1 | 10/2009 | Pao | |
| 2011/0006055 | A1 | 1/2011 | Diehl | |

FOREIGN PATENT DOCUMENTS

| | | | |
|---|---|---|---|
| CA | 2717607 | * | 9/2009 |
| DE | 102007040605 | | 10/2008 |
| DE | 102008062326 | | 9/2009 |
| DE | 10 2008 022176 | A1 | 11/2009 |
| EP | 0 135 966 | | 4/1985 |
| EP | 0418117 | A1 | 3/1991 |
| EP | 0563999 | A2 | 10/1993 |
| EP | 1106672 | A1 | 6/2001 |
| FR | 1586066 | A | 2/1970 |
| FR | 2925519 | A1 | 6/2009 |
| JP | 56050119 | A | 5/1981 |
| JP | 2246502 | A | 10/1990 |
| WO | WO 2007/133461 | | 11/2007 |
| WO | W02008/011412 | A2 | 1/2008 |
| WO | WO 2008/030337 | | 3/2008 |
| WO | WO2008098850 | A1 | 8/2008 |
| WO | WO2009027262 | A1 | 8/2008 |
| WO | WO2009/114934 | A1 | 9/2009 |

OTHER PUBLICATIONS

Butler, R. and Mokrys, I., "A New Process (VAPEX) for Recovering Heavy Oils Using Hot Water and Hydrocarbon Vapour", Journal of Canadian Petroleum Technology, 30(1), 97-106, 1991.

Butler, R. and Mokrys, I., "Recovery of Heavy Oils Using Vapourized Hydrocarbon Solvents: Further Development of the VAPEX Process", Journal of Canadian Petroleum Technology, 32(6), 56-62, 1993.

Butler, R. and Mokrys, I., "Closed Loop Extraction Method for the Recovery of Heavy Oils and Bitumens Underlain by Aquifers: the VAPEX Process", Journal of Canadian Petroleum Technology, 37(4), 41-50, 1998.

(56) References Cited

OTHER PUBLICATIONS

Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995.
Das, S.K. and Butler, R.M., "Diffusion Coefficients of Propane and Butane in Peace River Bitumen" Canadian Journal of Chemical Engineering, 74, 988-989, Dec. 1996.
Das, S.K. and Butler, R.M., "Mechanism of the Vapour Extraction Process for Heavy Oil and Bitumen", Journal of Petroleum Science and Engineering, 21, 43-59, 1998.
Dunn, S.G., Nenniger, E. and Rajan, R., "A Study of Bitumen Recovery by Gravity Drainage Using Low Temperature Soluble Gas Injection", Canadian Journal of Chemical Engineering, 67, 978-991, Dec. 1989.
Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 17-24, 1998.
Mokrys, I., and Butler, R., "In Situ Upgrading of Heavy Oils and Bitumen by Propane Deasphalting: The VAPEX Process", SPE 25452, presented at the SPE Production Operations Symposium held in Oklahoma City OK USA, Mar. 21-23, 1993.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008.
Nenniger, J.E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta Canada, Jun. 16-18, 2009.
Bridges, J.E., Sresty, G.C., Spencer, H.L. and Wattenbarger, R.A., "Electromagnetic Stimulation of Heavy Oil Wells", 1221-1232, Third International Conference on Heavy Oil Crude and Tar Sands, UNITAR/UNDP, Long Beach California, USA Jul. 22-31, 1985.
Carrizales, M.A., Lake, L.W. and Johns, R.T., "Production Improvement of Heavy Oil Recovery by Using Electromagnetic Heating", SPE115723, presented at the 2008 SPE Annual Technical Conference and Exhibition held in Denver, Colorado, USA, Sep. 21-24, 2008.
Carrizales, M. and Lake, L.W., "Two-Dimensional COMSOL Simulation of Heavy-Oil Recovery by Electromagnetic Heating", Proceedings of the COMSOL Conference Boston, 2009.
Chakma, A. and Jha, K.N., "Heavy-Oil Recovery from Thin Pay Zones by Electromagnetic Heating", SPE24817, presented at the 67th Annual Technical Conference and Exhibition of the Society of Petroleum Engineers held in Washington, DC, Oct. 4-7, 1992.
Chhetri, A.B. and Islam, M.R., "A Critical Review of Electromagnetic Heating for Enhanced Oil Recovery", Petroleum Science and Technology, 26(14), 1619-1631, 2008.
Chute, F.S., Vermeulen, F.E., Cervenan, M.R. and McVea, F.J., "Electrical Properties of Athabasca Oil Sands", Canadian Journal of Earth Science, 16, 2009-2021, 1979.
Davidson, R.J., "Electromagnetic Stimulation of Lloydminster Heavy Oil Reservoirs", Journal of Canadian Petroleum Technology, 34(4), 15-24, 1995.
Hu, Y., Jha, K.N. And Chakma, A., "Heavy-Oil Recovery from Thin Pay Zones by Electromagnetic Heating", Energy Sources, 21(1-2), 63-73, 1999.
Kasevich, R.S., Price, S.L., Faust, D.L. and Fontaine, M.F., "Pilot Testing of a Radio Frequency Heating System for Enhanced Oil Recovery from Diatomaceous Earth", SPE28619, presented at the SPE 69th Annual Technical Conference and Exhibition held in New Orleans LA, USA, Sep. 25-28, 1994.
Koolman, M., Huber, N., Diehl, D. and Wacker, B., "Electromagnetic Heating Method to Improve Steam Assisted Gravity Drainage", SPE117481, presented at the 2008 SPE International Thermal Operations and Heavy Oil Symposium held in Calgary, Alberta, Canada, Oct. 20-23, 2008.
Kovaleva, L.A., Nasyrov, N.M. and Khaidar, A.M., Mathematical Modelling of High-Frequency Electromagnetic Heating of the Bottom-Hole Area of Horizontal Oil Wells, Journal of Engineering Physics and Thermophysics, 77(6), 1184-1191, 2004.
McGee, B.C.W. and Donaldson, R.D., "Heat Transfer Fundamentals for Electro-thermal Heating of Oil Reservoirs", CIPC 2009-024, presented at the Canadian International Petroleum Conference, held in Calgary, Alberta, Canada Jun. 16-18, 2009.
Ovalles, C., Fonseca, A., Lara, A., Alvarado, V., Urrecheaga, K, Ranson, A. and Mendoza, H., "Opportunities of Downhole Dielectric Heating in Venezuela: Three Case Studies Involving Medium, Heavy and Extra-Heavy Crude Oil Reservoirs" SPE78980, presented at the 2002 SPE International Thermal Operations and Heavy Oil Symposium and International Horizontal Well Technology Conference held in Calgary, Alberta, Canada, Nov. 4-7, 2002.
Rice, S.A., Kok, A.L. and Neate, C.J., "A Test of the Electric Heating Process as a Means of Stimulating the Productivity of an Oil Well in the Schoonebeek Field", CIM 92-04 presented at the CIM 1992 Annual Technical Conference in Calgary, Jun. 7-10, 1992.
Sahni, A. and Kumar, M. "Electromagnetic Heating Methods for Heavy Oil Reservoirs", SPE62550, presented at the 2000 SPE/AAPG Western Regional Meeting held in Long Beach, California, Jun. 19-23, 2000.
Sayakhov, F.L., Kovaleva, L.A. and Nasyrov, N.M., "Special Features of Heat and Mass Exchange in the Face Zone of Boreholes upon Injection of a Solvent with a Simultaneous Electromagnetic Effect", Journal of Engineering Physics and Thermophysics, 71(1), 161-165, 1998.
Spencer, H.L., Bennett, K.A. and Bridges, J.E. "Application of the IITRI/Uentech Electromagnetic Stimulation Process to Canadian Heavy Oil Reservoirs" Paper 42, Fourth International Conference on Heavy Oil Crude and Tar Sands, UNITAR/UNDP, Edmonton, Alberta, Canada, Aug. 7-12, 1988.
Sresty, G.C., Dev, H., Snow, R.N. and Bridges, J.E., "Recovery of Bitumen from Tar Sand Deposits with the Radio Frequency Process", SPE Reservoir Engineering, 85-94, Jan. 1986.
Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 25-29, 2000.
Schelkunoff, S.K. and Friis, H.T., "Antennas: Theory and Practice", John Wiley & Sons, Inc., London, Chapman Hall, Limited, pp. 229-244, 351-353, 1952.
Gupta, S.C., Gittins, S.D., "Effect of Solvent Sequencing And Other Enhancement On Solvent Aided Process", Journal of Canadian Petroleum Technology, vol. 46, No. 9, pp. 57-61, Sep. 2007.
United States Patent and Trademark Office, Non-final Office action issued in U.S. Appl. No. 12/396,247, dated Mar. 28, 2011.
United States Patent and Trademark Office, Non-final Office action issued in U.S. Appl. No. 12/396,284, dated Apr. 26, 2011.
Patent Cooperation Treaty, Notification of Transmittal of the International Search Report and The Written Opinion of the International Searching Authority, or the Declaration, in PCT/US2010/025808, dated Apr. 5, 2011.
Deutsch, C.V., McLennan, J.A., "The Steam Assisted Gravity Drainage (SAGD) Process," Guide to SAGD (Steam Assisted Gravity Drainage) Reservoir Characterization Using Geostatistics, Centre for Computational Statistics (CCG), Guidebook Series, 2005, vol. 3; p. 2, section 1.2, published by Centre for Computational Statistics, Edmonton, AB, Canada.
Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of The Institution of Electrical Engineers, © 1986.
Marcuvitz, Nathan, Waveguide Handbook; 1986; Institution of Engineering and Technology, vol. 21 of IEE Electromagnetic Wave series, ISBN 0863410588, Chapter 2.3, pp. 66-72, published by Peter Peregrinus Ltd. on behalf of The Institution of Electrical Engineers, © 1986.
"Oil sands." Wikipedia, the free encyclopedia. Retrieved from the Internet from: http://en.wikipedia.org/w/index.php?title=Oil_sands &printable=yes, Feb. 16, 2009.

(56) References Cited

OTHER PUBLICATIONS

Sahni et al., "Electromagnetic Heating Methods for Heavy Oil Reservoirs." 2000 Society of Petroleum Engineers SPE/AAPG Western Regional Meeting, Jun. 19-23, 2000.
Power et al., "Froth Treatment: Past, Present & Future." Oil Sands Symposium, University of Alberta, May 3-5, 2004.
Flint, "Bitumen Recovery Technology A Review of Long Term R&D Opportunities." Jan. 31, 2005. LENEF Consulting (1994) Limited.
"Froth Flotation." Wikipedia, the free encyclopedia. Retrieved from the internet from: http://en.wikipedia.org/wiki/Froth_flotation, Apr. 7, 2009.
"Relative static permittivity." Wikipedia, the free encyclopedia. Retrieved from the Internet from http://en.wikipedia.org/w/index/php?title=Relative_static_permittivity&printable=yes, Feb. 12, 2009.
"Tailings." Wikipedia, the free encyclopedia. Retrieved from the Internet from http://en.wikipedia.org/w/index.php?title=Tailings &printable=yes, Feb. 12, 2009.
"Technologies for Enhanced Energy Recovery" Executive Summary, Radio Frequency Dielectric Heating Technologies for Conventional and Non-Conventional Hydrocarbon-Bearing Formulations, Quasar Energy, LLC, Sep. 3, 2009, pp. 1-6.
Burnhan, "Slow Radio-Frequency Processing of Large Oil Shale Volumes to Produce Petroleum-like Shale Oil," U.S. Department of Energy, Lawrence Livermore National Laboratory, Aug. 20, 2003, UCRL-ID-155045.
Sahni et al., "Electromagnetic Heating Methods for Heavy Oil Reservoirs," U.S. Department of Energy, Lawrence Livermore National Laboratory, May 1, 2000, UCL-JC-138802.
Abernethy, "Production Increase of Heavy Oils by Electromagnetic Heating," The Journal of Canadian Petroleum Technology, Jul.-Sep. 1976, pp. 91-97.
Sweeney, et al., "Study of Dielectric Properties of Dry and Saturated Green River Oil Shale," Lawrence Livermore National Laboratory, Mar. 26, 2007, revised manuscript Jun. 29, 2007, published on Web Aug. 25, 2007.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.
Kinzer, A Review of Notable Intellectual Property for In Situ Electromagnetic Heating of Oil Shale, Quasar Energy LLC.
A. Godio: "Open ended-coaxial Cable Measurements of Saturated Sandy Soils", American Journal of Environmental Sciences, vol. 3, No. 3, 2007, pp. 175-182, XP002583544.
Carlson et al., "Development of the I IT Research Institute RF Heating Process For In Situ Oil Shale/Tar Sand Fuel Extraction—An Overview", Apr. 1981.
PCT International Search Report and Written Opinion in PCT/US2010/025763, Jun. 4, 2010.
PCT International Search Report and Written Opinion in PCT/US2010/025807, Jun. 17, 2010.
PCT International Search Report and Written Opinion in PCT/US2010/025804, Jun. 30, 2010.
PCT International Search Report and Written Opinion in PCT/US2010/025769, Jun. 10, 2010.
PCT International Search Report and Written Opinion in PCT/US2010/025765, Jun. 30, 2010.
PCT International Search Report and Written Opinion in PCT/US2010/025772, Aug. 9, 2010.
PCT Notification of Transmittal of the International Search Report and The Written Opinion of the International Searching Authority, or the Declaration, in PCT/US2010/025761, dated Feb. 9, 2011.
PCT Notification of Transmittal of the International Search Report and The Written Opinion of the International Searching Authority, or the Declaration, in PCT/US2010/057090, dated Mar. 3, 2011.
"Control of Hazardous Air Pollutants From Mobile Sources", U.S. Environmental Protection Agency, Mar. 29, 2006. p. 15853 (http://www.epa.gov/EPA-AIR/2006/March/Day-29/a2315b.htm).
Von Hippel, Arthur R., Dielectrics and Waves, Copyright 1954, Library of Congress Catalog Card No. 54-11020, Contents, pp. xi-xii; Chapter II, Section 17, "Polyatomic Molecules", pp. 150-155; Appendix C-E, pp. 273-277, New York, John Wiley and Sons.

* cited by examiner

LITZ HEATING ANTENNA

CROSS REFERENCE TO RELATED APPLICATIONS

This specification is related to U.S. patent application Ser. Nos. 12/839,927 filed Jul. 20, 2010, 12/878,774 filed Sep. 9, 2010, 12/903,684 filed Oct. 13, 2010, 12/820,977 filed Jun. 22, 2010, 12/835,331 filed Jul. 13, 2010, each of which is hereby incorporated herein in its entirety by reference.

This specification is also related to U.S. Serial Nos:

Ser. No. 12/396,284, filed Mar. 2, 2009
Ser. No. 12/396,247, filed Mar. 2, 2009
Ser. No. 12/396,192, filed Mar. 2, 2009
Ser. No. 12/396,057, filed Mar. 2, 2009
Ser. No. 12/396,021, filed Mar. 2, 2009
Ser. No. 12/395,995, filed Mar. 2, 2009
Ser. No. 12/395,953, filed Mar. 2, 2009
Ser. No. 12/395,945, filed Mar. 2, 2009
Ser. No. 12/395,918, filed Mar. 2, 2009 each of which is incorporated by reference here.

BACKGROUND OF THE INVENTION

The present invention relates to heating a geological formation for the extraction of hydrocarbons. In particular, the present invention relates to an advantageous applicator, system, and method that can be used to heat a geological formation to extract heavy hydrocarbons.

As the world's standard crude oil reserves are depleted and the continued demand for oil causes oil prices to rise, oil producers are attempting to process hydrocarbons from bituminous ore, oil sands, tar sands, and heavy oil deposits. These materials are often found in naturally occurring mixtures of sand or clay. Because of the extremely high viscosity of bituminous ore, oil sands, oil shale, tar sands, and heavy oil, the drilling and refinement methods used in extracting standard crude oil are typically not available. Therefore, recovery of oil from these deposits requires heating to separate hydrocarbons from other geologic materials and maintaining hydrocarbons at temperatures at which they will flow.

Current technology heats the hydrocarbon formations through the use of steam and sometimes through the use of electric or radio frequency heating. Steam has been used to provide heat in-situ, such as through a steam assisted gravity drainage (SAGD) system. Steam enhanced oil recovery (EOR) may require caprock over the hydrocarbon formations to contain the steam. The use of steam in permafrost regions may be problematic because it can melt the permafrost along the well near the surface.

RF heating is heating using one or more of three energy forms: electric currents, electric fields, and magnetic fields at radio frequencies. Depending on operating parameters, the heating mechanism may be resistive by joule effect or dielectric by molecular moment. Resistive heating by joule effect is often described as electric heating, where electric current flows through a resistive material. Dielectric heating occurs where polar molecules, such as water, change orientation when immersed in an electric field. Magnetic fields also heat electrically conductive materials through eddy currents, which heat resistively.

RF heating can use electrically conductive antennas to function as heating applicators. The antenna is a passive device that converts applied electrical current into electric fields, magnetic fields, and electrical current fields in the target material without having to heat the antenna structure to a specific threshold level. Preferred antenna shapes can be Euclidian geometries, such as lines and circles. Additional background information on dipole antennas can be found at *Antennas: Theory and Practice* by S. K. Schelkunoff and H. T. Friis, Wiley New York, 1952, pp 229-244, 351-353. The radiation patterns of antennas can be calculated by taking the Fourier transform of the antenna's electric current flow. Modern techniques for antenna field characterization may employ digital computers and provide for precise RF heat mapping.

Antennas can be made from many things including Litz conductors. Litz conductors are often composed of wire rope which can reduce resistive losses in electrical wiring. Each of the conductive strands used to form the Litz conductor has a nonconductive insulation film over it. The individual stands may be about 1 RF skin depth in diameter at the frequency of usage. The strands are variously bundled, twisted, braided or plaited to force the individual strands to occupy all positions in the cable. In this way the current must be shared equally between strands. Thus, Litz conductors reduce the ohmic losses by reducing the RF skin effect in electrical wiring. Litz conductors are sometimes known as Litzendraught conductors and the term may relate to "lace telegraph wire" in German.

U.S. Pat. No. 7,205,947 entitled "Litzendraught Loop Antenna and Associated Methods" to Parsche describes a wire loop antenna of Litz conductor construction. The strands are severed at intervals to introduce distributed capacitance for tuning purposes and the Litz conductor loop is fed inductively from a second nonresonant loop.

SUMMARY OF THE INVENTION

An aspect of at least one embodiment of the present invention is an energy applicator. The applicator includes a first strand and a second strand, each of which has an insulated portion, a bare portion, and is made up of at least one wire. The first and second strands are braided, twisted, or both braided and twisted together such that the bare portion of each strand is adjacent to the insulated portion of the other strand.

Another aspect of at least one embodiment of the present invention involves a system for heating a geological formation to extract hydrocarbons. The system includes an applicator connected to an RF transmitter source, an applicator bore, an extraction bore, and a pump. The applicator bore extends into the formation. The applicator is located inside the applicator bore and positioned to radiate energy into the formation. At least a portion of the applicator bore that extends into the formation does not have a metallic casing. The extraction bore is positioned below the applicator bore and connected to a pump for removing hydrocarbons from the extraction bore.

Yet another aspect of at least one embodiment of the present invention involves a method for heating a geological formation to extract hydrocarbons including the steps of providing an applicator bore that extends into the formation, not having a metallic casing in at least a portion of the applicator bore that extends into the formation; providing an applicator in the applicator bore; providing an extraction bore positioned below the applicator bore; connecting the applicator to RF power transmitting equipment; applying RF power to the applicator; and pumping hydrocarbons out of the extraction bore.

Other aspects of the invention will be apparent from this disclosure.

DETAILED DESCRIPTION OF THE PREFERRED EMBODIMENTS

The subject matter of this disclosure will now be described more fully, and one or more embodiments of the invention are shown. This invention may, however, be embodied in many different forms and should not be construed as limited to the embodiments set forth herein. Rather, these embodiments are examples of the invention, which has the full scope indicated by the language of the claims.

Figure 1:
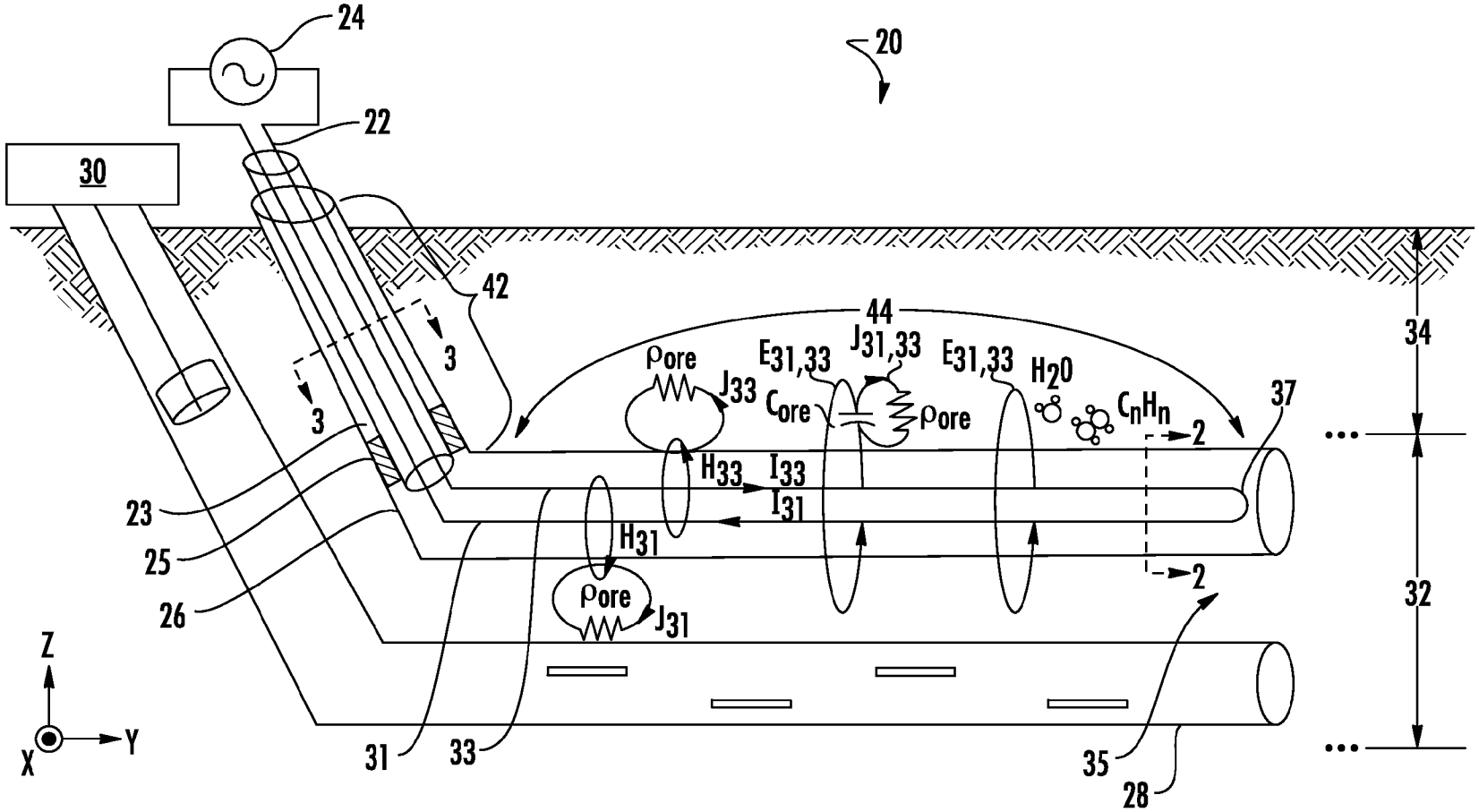
FIG. 1 is a diagrammatic cutaway view of an embodiment of a system for heating a geological formation to extract hydrocarbons.

In FIG. 1 an embodiment of the present invention is shown as a system for heating a geological formation and extracting hydrocarbons, generally indicated as 20. The system 20 includes at least an applicator 22 connected to an RF transmitter source 24, an applicator bore 26, an extraction bore 28, and a pump 30. The applicator bore 26 is made in such a way that it extends into the formation 32. The applicator 22 is located inside the applicator bore 26 and positioned to radiate or transduce electromagnetic energies into the formation 32. The extraction bore 28 is positioned below the applicator bore 26 and connected to a pump 30 that removes hydrocarbons from the extraction bore 28. The system 20 may also include a conductive shield 23.

The embodiment shown in FIG. 1 can be used in many applications including, but not limited to, bitumen or kerogen extraction, coal gasification, and environmental/spill remediation. In this embodiment the formation 32 is usually a geological formation composed of hydrocarbons such as bituminous ore, oil sands, oil shale, tar sands, or heavy oil. Susceptors are materials that heat in the presence of RF electromagnetic energies. Salt water is a particularly good susceptor for RF heating because it can respond to all three RF energies: electric currents, electric fields, magnetic fields. Oil sands and heavy oil formations commonly contain connate liquid water and salt in sufficient quantities to serve as an RF heating susceptor. For instance, in the Athabasca region of Canada and at 1 KHz frequency, rich oil sand (15% bitumen) may have about 0.5-2% water by weight, an electrical conductivity of about 0.01 mhos per meter (m/m), and a relative dielectric permittivity of about 120. Since bitumen melts below the boiling point of water, liquid water may be a used as an RF heating susceptor during bitumen extraction, thereby permitting well stimulation by the application of RF energy. In general, RF heating has superior penetration and speed to conductive heating in hydrocarbon. RF heating may also have properties of thermal regulation because steam is not an RF heating susceptor.

Figure 2:
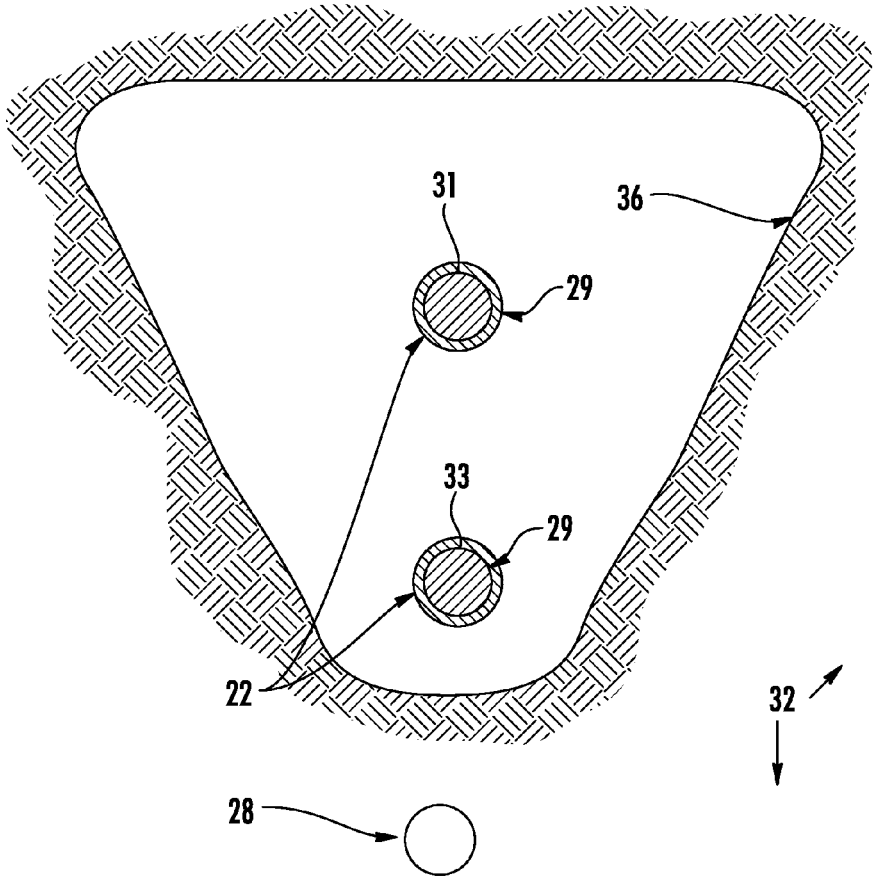
FIG. 2 is a cross sectional view of the applicator and applicator bore from FIG. 1.

There will often be an additional layer of earth covering the formation 32 called the overburden 34. The applicator bore 26 penetrates the overburden 34 and extends into the formation 32. In this embodiment, the applicator bore 26 is uncased in the formation 32 so that the applicator 22 lies directly inside the applicator bore 26. FIG. 2 shows a cross sectional view of line 2-2 of the applicator bore 26 from FIG. 1. As shown, there may be a void such as air or steam saturated sand between the applicator 22 and the inside wall 36 of the formation 32. The void may be a region of the formation 32 from which the oil and liquid water have been produced. In this embodiment, the applicator 22 has two conductive portions (31,33) and may be covered by electrical insulation 29. The electrical insulation 29 may be a non-conductive material, for example an electrically, nonconductive jacket like extruded Teflon.

The applicator 22 shown in FIG. 1 may have a first transmission portion 42 and a second heating portion 44. This may be beneficial for many reasons including improved control over, and targeting of, the RF heating energies. The transmission portion 42 may include a conductive shield 23, such as a metal tube, to prevent unwanted heating in the overburden 34. The conductive shield 23 may be covered in a RF magnetic material 25 such as ferrite or powdered iron to further prevent heating in the overburden 34. The RF magnetic material 25 can enhance electromagnetic shielding by suppressing electrical current flow on the surfaces of the conductive shield 23. The RF magnetic material 25 may be powder mixed into the Portland cement casing that commonly seals oil wells into the earth, or a powder mixed into silicon rubber. The RF magnetic material 25 is preferentially a bulk nonconductive magnetic material so the magnetic material structure may include laminations, small particles or crystalline lattice microstructures. When using a conductive shield 23, it may be preferable to use a RF transmitter source that consists of a three phase Y electrical network including three AC current sources having phase angles of 1, 120, and 240 degrees. The Y network provides a ground or earth connection terminal that can be advantageous for stabilizing the electrical potential of the conductive shield 23. At low frequencies, below approximately 100 hertz, the conductive shield 23 may not be useful because nonconductive insulation may be sufficient to prevent unwanted heating. The conductive shield 23 is directed to containment of electric and magnetic fields that heat the formation 32 at higher radio frequencies.

Figure 3:
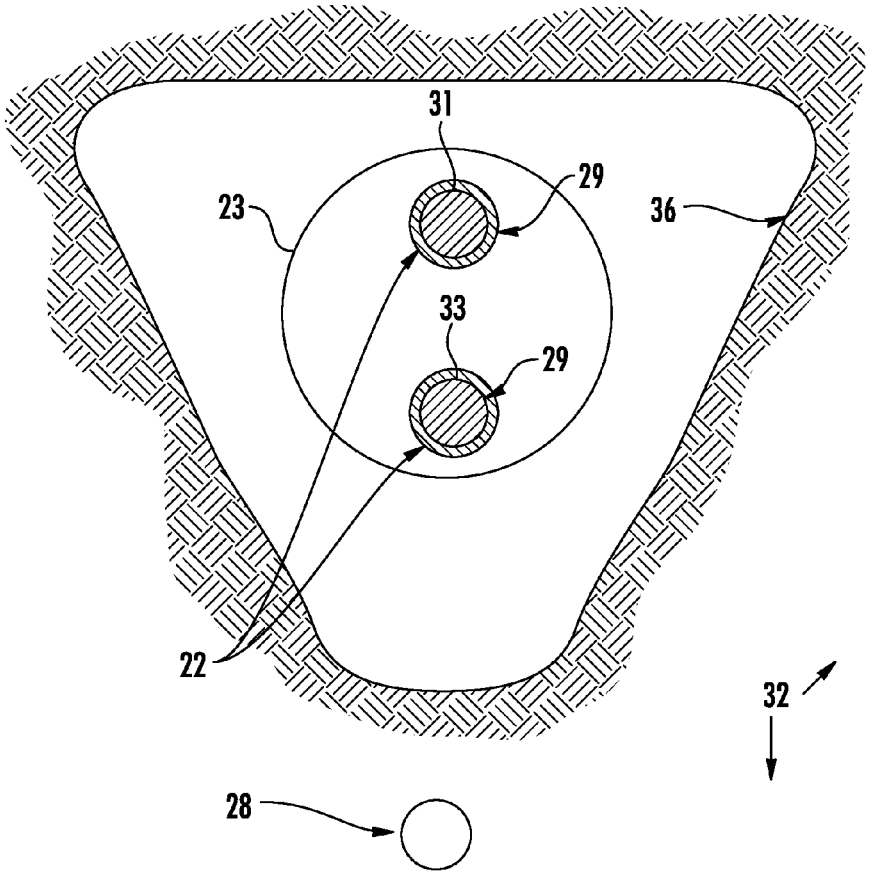
FIG. 3 is a cross sectional view of the transmission portion of the applicator surrounded by a conductive shield and located in the applicator bore from FIG. 1 in which the applicator is insulated.

The applicator 22 is composed of an elongated conductive structure including at least two conductive portions (31,33) oriented parallel to each other. The conductive portions (31, 33) are electrically insulated from each other by various means including, but not limited to, physical separation with nonconductive spacers (not shown) or the use of electrical insulation 29 like extruded Teflon. In this embodiment, the applicator 22 is an insulated metal wire running down the applicator bore 26 from the surface and then folding back on itself to return to the surface, forming a highly elongated loop or "hairpin". The conductive portions (31,33) of the applicator 22 may also consist of metal pipes among other things. There may or may not be a conductive end connection 37 at the terminal end 35 of the applicator bore 26. Including the conductive end connection 37 can increase inductance for the enhancement of magnetic fields while not including the conductive end connection 37 can increase capacitance to enhance the production of electric fields. FIG. 3 is a cross sectional view of line 3-3 of the applicator bore 26 from FIG. 1. In this embodiment the first transmission portion 42 is surrounded by electrical insulation 29 and located in the conductive shield 23 which in turn is located in the applicator bore 26.

Referring back to FIG. 1, the heating portion 44 of applicator 22 is preferentially located in the formation 32 which may be a hydrocarbon ore strata. The applicator 22 can heat the formation 32 by several means and energy types depending on the radio frequency, the ore characteristics, and the use of a conductive end connection 37, among other factors. One means is magnetic near field heating where magnetic fields $H_{31}$, $H_{33}$ are formed by the conductive portions 31, 33 of the applicator 22 according to Ampere's Law. The magnetic fields $H_{31}$, $H_{33}$ in turn cause eddy electric currents $J_{31}$, $J_{33}$ to flow according to Lentz's Law. These eddy electric currents $J_{31}$, $J_{33}$ flow in the electrical resistance $\rho_{ore}$ of formation 32 so that $I^2R$ electrical resistance heating occurs in formation 32 according to Joule Effect. Electrically conductive contact between the applicator 22 and the formation 32 is not required. A simple analogy is that the applicator 22 acts like the primary winding of a transformer while the eddy currents in formation 32 act like the secondary winding.

Another means is displacement current heating where electric near fields $E_{31,33}$ are created by the applicator 22. These E fields are captured by the formation 32 due to the capacitance $C_{ore}$ between the formation 32 and the applicator 22. The electric near fields $E_{31,33}$ in turn create conduction currents $J_{31,33}$ which flow through the resistance $\rho_{ore}$ of the formation 32 causing $I^2R$ heating by joule effect. Thus, an electrical coupling occurs between the applicator 22 and the formation 32 by capacitance.

Yet another means that is available at relatively high frequencies is dielectric heating. In dielectric heating the molecules of formation 32, which may include polar liquid water molecules $H_20$ or hydrocarbon molecules $C_nH_n$, are immersed in electric fields $E_{31,33}$ of the applicator 22. The electric fields $E_{31,33}$ may be of the near reactive type, the far field radiated type, or both. Dielectric heating is caused by molecular rotation which occurs due to the electrical dipole moment. When the molecules are agitated in this way the temperature of the formation 32 increases. The present invention thus provides multiple mechanisms to provide reliable heating of the formation 32 without any electrical contact between the applicator 22 and the formation 32

Without being bound by the accuracy or application of this theory, the electromagnetic fields generated by applicator 22 of FIG. 1 will be considered in greater detail. In operation, the conductive portions 31, 33 of the applicator 22 carry electric currents $I_{31}$ and $I_{33}$ which may be approximately equal in amplitude and which flow in opposite directions. When electrically insulated from the formation 32, these antiparallel currents may transduce as many as eight electromagnetic energy components which are described in the following table:

Electromagnetic Energies Of The FIG. 1 Embodiment

| Component | Energy type | Region |
|---|---|---|
| $H_z$ | Magnetic (H) | Reactive near |
| $H_\rho$ | Magnetic (H) | Reactive near |
| $E\phi$ | Electric (E) | Reactive near |
| $H_z$ | Magnetic (H) | Middle/cross field |
| $H_\rho$ | Magnetic (H) | Middle/cross field |
| $E\phi$ | Electric (E) | Middle/cross field |

-continued

Electromagnetic Energies Of The FIG. 1 Embodiment

| Component | Energy type | Region |
|---|---|---|
| $E_\theta$ | Electric (E) | Far field (radio wave) |
| $H_\rho$ | Magnetic (H) | Far field (radio wave) |

Of the eight energies, near-field (and especially near field by the application of magnetic near fields) may be preferential for deep heat penetration in hydrocarbon ores. The three near field components can be further described as:

$$H_z=-jE_0/2\pi\eta[(e^{-jkr1}/r_1)+(e^{-jkr2}/r_2)]$$

$$H_\rho=-jE_0/2\pi\eta[(z-\lambda/4)/\rho)(e^{-jkr1}/r_1)+(z-\lambda/4)/\rho)(e^{-jkr2}/r_2)]$$

$$E_\phi=-jE_0/2\pi[(e^{-jkr1})+(e^{-jkr2})]$$

Where:

$\rho$, $\phi$, z are the coordinates of a cylindrical coordinate system in which the applicator 22 is coincident with the Z axis $r_1$ and $r_2$ are the distances from the applicator 22 to the point of observation $\eta$=the impedance of free space=120$\pi$ E=the electric field strength in volts per meter H=the magnetic field strength in amperes per meter These equations are exact for free space and approximate for hydrocarbon ores.

While the middle fields from the applicator 22 are in time phase together and typically convey little energy for heating, the radiated far fields from the applicator 22 may be useful for electromagnetic heating. Radiated far field heating will generally occur when the parallel conductive portions 31, 33 of the applicator 22 are sufficiently spaced from the formation 32 to support wave formation and expansion at the radio frequency in use. Radiated far fields exist only beyond the antenna radiansphere ("The Radiansphere Around A Small Antenna", Harold A. Wheeler, Proceedings of the IRE, August 1959, pages 1335-1331) and for many purposes the far field distance may be calculated as $r>\lambda/2\pi$, where r is the radial distance from the applicator 22 and $\lambda$ is the wavelength in the material surrounding the applicator 22.

Thus, near field heating may predominate when the applicator 22 is closely immersed in the formation 32, and far field heating may predominate when the applicator 22 is spaced away from the formation 32. Near field heating may initially predominate and the far field heating may emerge as the ore is withdrawn and an underground cavity or ullage forms around the applicator 22. For example, if the applicator 22 was placed along the axis of a cylindrical earth cavity 1 meter in diameter (r=0.5 meter), the lowest radio frequency that would support far field radiation heating with radio waves would be approximately $f=c/2\pi\ r=3.0\times10^8/2(3.14)\ (0.5)=95.5\times10^6$ hertz=95.5 MHz. The surface area of the cavity may be integrated for and divided by the transmitter power to obtain the applied per flux density in $w/m^2$ at the ore cavity face. In far field heating, the RF skin depth in formation 32 closely determines the heating gradient in formation 32. Near field heating does not require a cavity in the formation 32 and the applicator 22 may of course be closely immersed in the ore.

Background on the field regions of linear antennas is described in the text "Antenna Theory Analysis and Design", Constantine A. Balanis, 1st edition, copyright 1982, Chapter 4, Linear Wire Antennas. As hydrocarbon formations are frequently anisotropic and inhomogeneous, digital computer based computational methods can be valuable. Finite element and moment method algorithms have also been employed to map the heating and electrical parameters of the present invention. Liquid water molecules, which are present in many hydrocarbon ore formations, generally heat much faster than the associated sand, rock, or hydrocarbon molecules. Heating of the in situ liquid water by electromagnetic energy in turn heats the hydrocarbons conductively. Electromagnetic heating may thermally regulate at the saturation temperature of the in situ water, a temperature that is sufficient to melt bitumen ores. The hydrocarbon ore can be electrically conductive due to the in situ liquid water and the ionic species present in it. As a result, warming the hydrocarbon ore reduces the viscosity and increases well production.

When the applicator 22 is electrically insulated 29, as shown in FIG. 2, since the near H fields are strongest broadside to the conductor plane when the conductive portions 31, 33 are coplanar, e.g. not twisted, the conductive portions 31, 33 may be twisted together (not shown) to make the heating pattern more uniform. The conductive portions 31, 33 may be composed of Litz type conductors to increase the ampacity of the applicator 22, although this is not required. Sufficient heat penetration with adequate ore electrical load resistance may occur in Athabasca oil sands at frequencies between about 0.5 to 50 KHz. Raising the frequency of the RF transmitter source 24 increases the electrical load resistance provided by the formation 32, which is then referred or conveyed by the applicator 22 back to the RF transmitter source 24. Cooling provisions (not shown) for the conductive portions 31, 33 of the applicator 22, such as ethylene glycol circulation, may also be included.

Electromagnetic heating at a frequency of 1 KHz in Athabasca oil sand may form a radial thermal gradient of between $1/r^5$ to $1/r^7$ and an instantaneous 50 percent radial heat penetration depth (watts/meter cubed) of approximately 9 meters. The radial direction is of course normal to the conductive portions 31, 33 of the applicator 22. This instantaneous penetration of electromagnetic heating energy is an advantage over heating by conduction or convection, both of which build up slowly over time. Although there are many variables, rates of power application to a 1 kilometer long horizontal directional drilling well in bituminous ore may be about 2 to 10 megawatts. This power may be reduced for production after startup.

Figure 11:
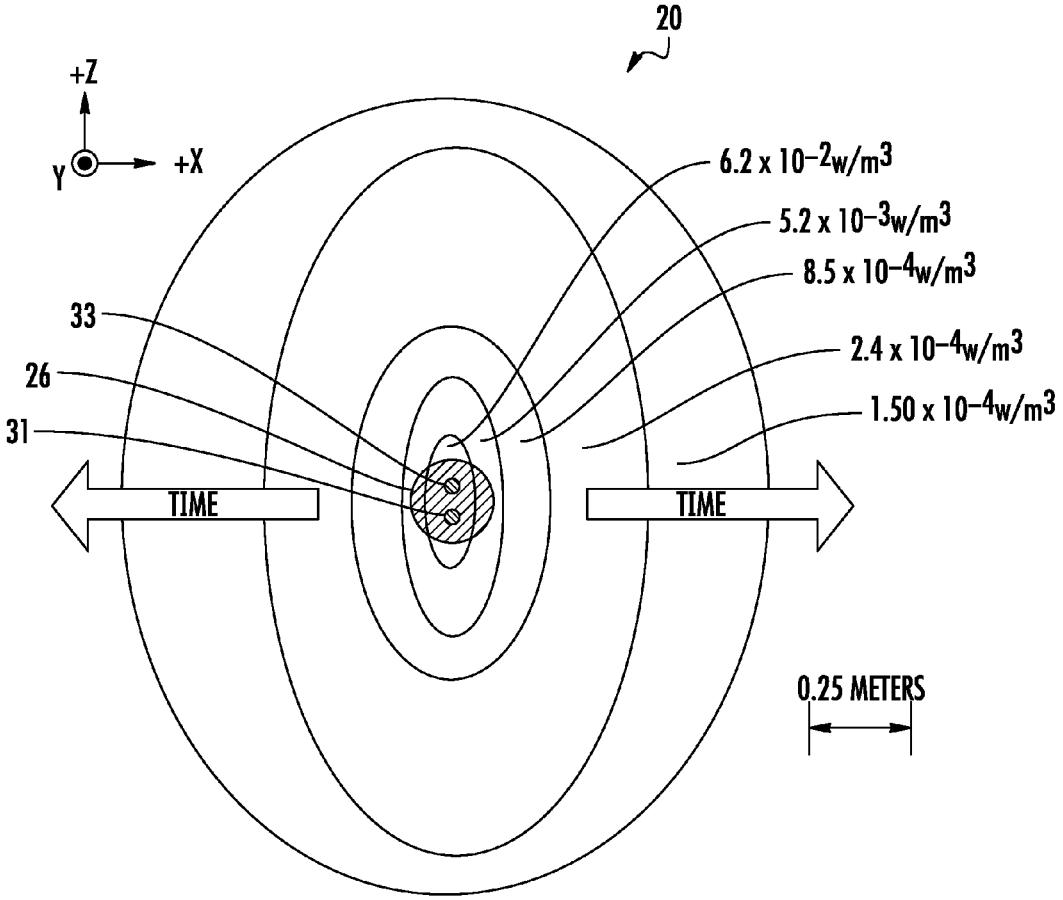
FIG. 11 is an example contour plot of the heating rate in the formation created by the FIG. 1 applicator.

In FIG. 11, an example map of the rate of heat application in watts per meter cubed across a cross section of the applicator 22 of system 20, is provided. The applicator 22 is oriented parallel to the y-axis. At the surface of the applicator 22, time is at t=0 and the RF transmitter source 24 has just been turned on. The applied RF power is 5 megawatts, the radio frequency is 10 kilohertz, and the heating portion 44 of the applicator 22 is 1000 meters long. The formation 32 has a conductivity of 0.002 mhos/meter and a relative permittivity of 80 as may be characteristic of rich Athabasca oil sand at 10 kilohertz. The heating grows radially outward, as well as longitudinally along the applicator 22 to the far end 35, over time as the in situ liquid water of the formation 32 adjacent to the applicator 22 saturates into steam. There is a temperature gradient at the walls of the saturation zone that ranges from the steam saturation temperature to the ambient temperature of the ore formation. In far field electromagnetic heating, the slope of the temperature gradient at the edge of the saturation zone may be adjusted by adjusting the radio frequency of the RF transmitter source 24. The rate of heat application to the formation 32 may be adjusted by adjusting the electrical power supplied by the RF transmitter source 24.

Figure 4:
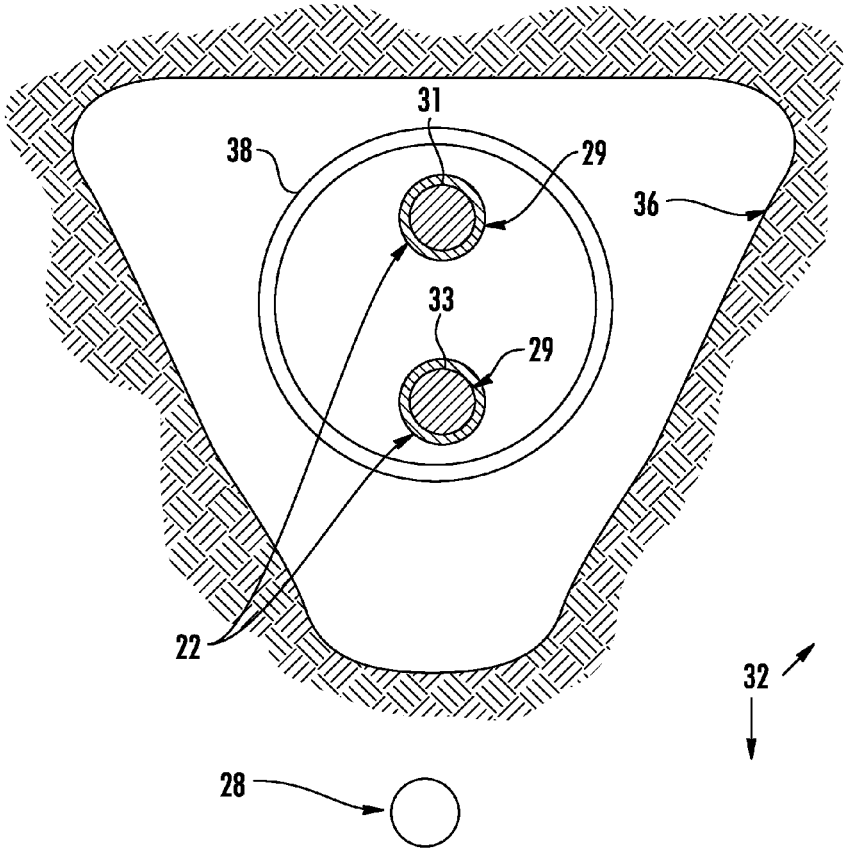
FIG. 4 is a cross sectional view of the applicator and applicator bore from FIG. 1 including a non-metallic casing.
Figure 5:
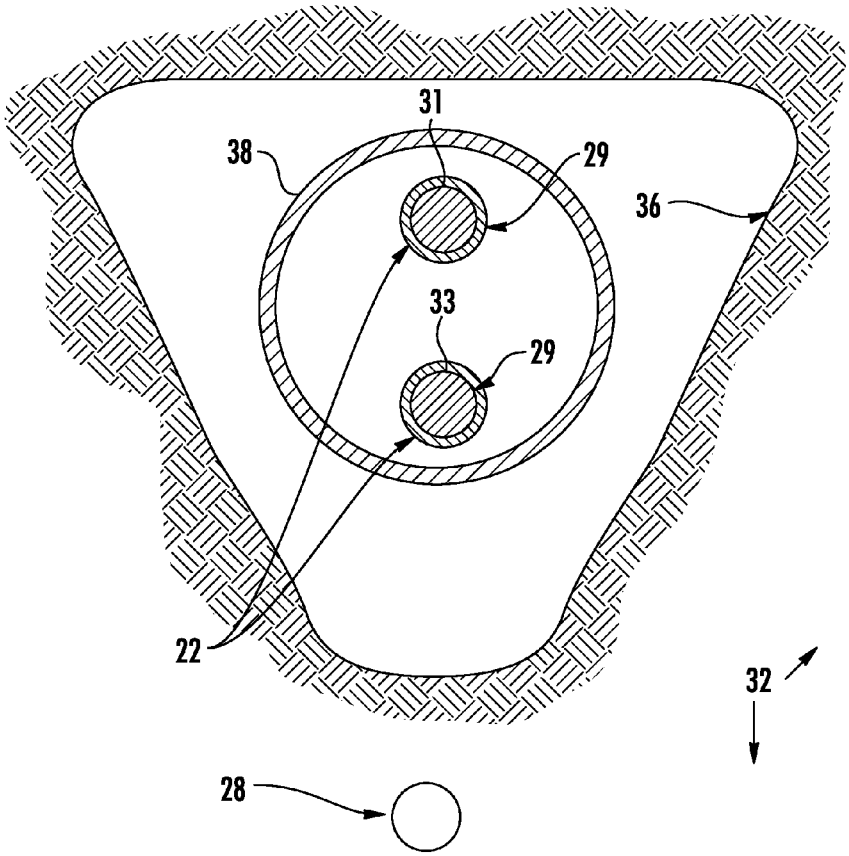
FIG. 5 is a cross sectional view of the applicator and applicator bore from FIG. 1 including a metallic casing.

In other embodiments of system 20 shown in FIG. 1 it may be preferable to have a casing inside the applicator bore 26 depending upon the type of applicator 22 and the method of heating that are utilized. FIG. 4 and FIG. 5 show other examples of cross sectional views of line 2-2 of the applicator bore 26 from FIG. 1 where the applicator bore 26 is cased with either a non-metallic casing 38 or a metallic casing 40, respectively. Over time an uncased applicator bore 26 commonly will collapse, bringing the applicator 22 in contact with the formation 32. Without being bound by the accuracy or application of this theory, it is believed that the collapse of the bore 26 will at least in some instances increase the resistive heating effect and dielectric heating effect of the applicator 22 by bringing water in the formation 32 directly in contact with the applicator 22. The alternative option of casing the applicator bore 26 may be preferable if it is intended for the applicator 22 to be reused or replaced since it will commonly be difficult to remove an applicator 22 from a collapsed applicator bore 26.

In some situations it may be preferable to use a casing that extends the entire length of the applicator bore 26, but this is by no means necessary. There are situations where it may be desirable to case only a portion of the applicator bore 26 or even use different casing materials in different portions of the applicator bore 26. For example, when using the system 20 for low frequency resistive heating applications, a non-metallic casing 38 can be used to maintain the integrity of the applicator bore 26. Another example is an application in which high frequency dielectric heating is utilized. In that situation it may be desirable to leave the portion of the applicator bore 26 that extends into the formation 32 uncased, or cased with a non-metallic casing 38, to promote heating, while at the same time casing the portion of the applicator bore 26 extending through the overburden 34 with a metallic casing 40 to inhibit heating.

Yet another embodiment of system 20 is to use of the applicator 22 in conjunction with steam injection heating (SAGD or periodic, not shown). The electromagnetic heating effects provide synergy to initiate the convective flow of the steam into the ore formation 32 because the electromagnetic heat may have a half power instantaneous radial penetration depth of 10 meters and more in bituminous ores. Thus, well start up time may be reduced significantly because it will no longer take many months to initiate steam convection. If electromagnetic heating alone is employed, without steam injection, the need for caprock of the heavy oil or bitumen may be reduced or eliminated. Electromagnetic heating may be enabling in permafrost regions where steam injection may be difficult to impossible to implement due to melting of the permafrost around the steam injection well near the surface. Unlike steam EOR, the transmission portion 42 of system 20 does not heat the overburden 34, which would include permafrost, due in part to the conductive shield 23 and the frequency magnetic material 25. Thus, the present invention may be a means to recover stranded hydrocarbon reserves currently unsuitable for steam based EOR.

Figure 6:
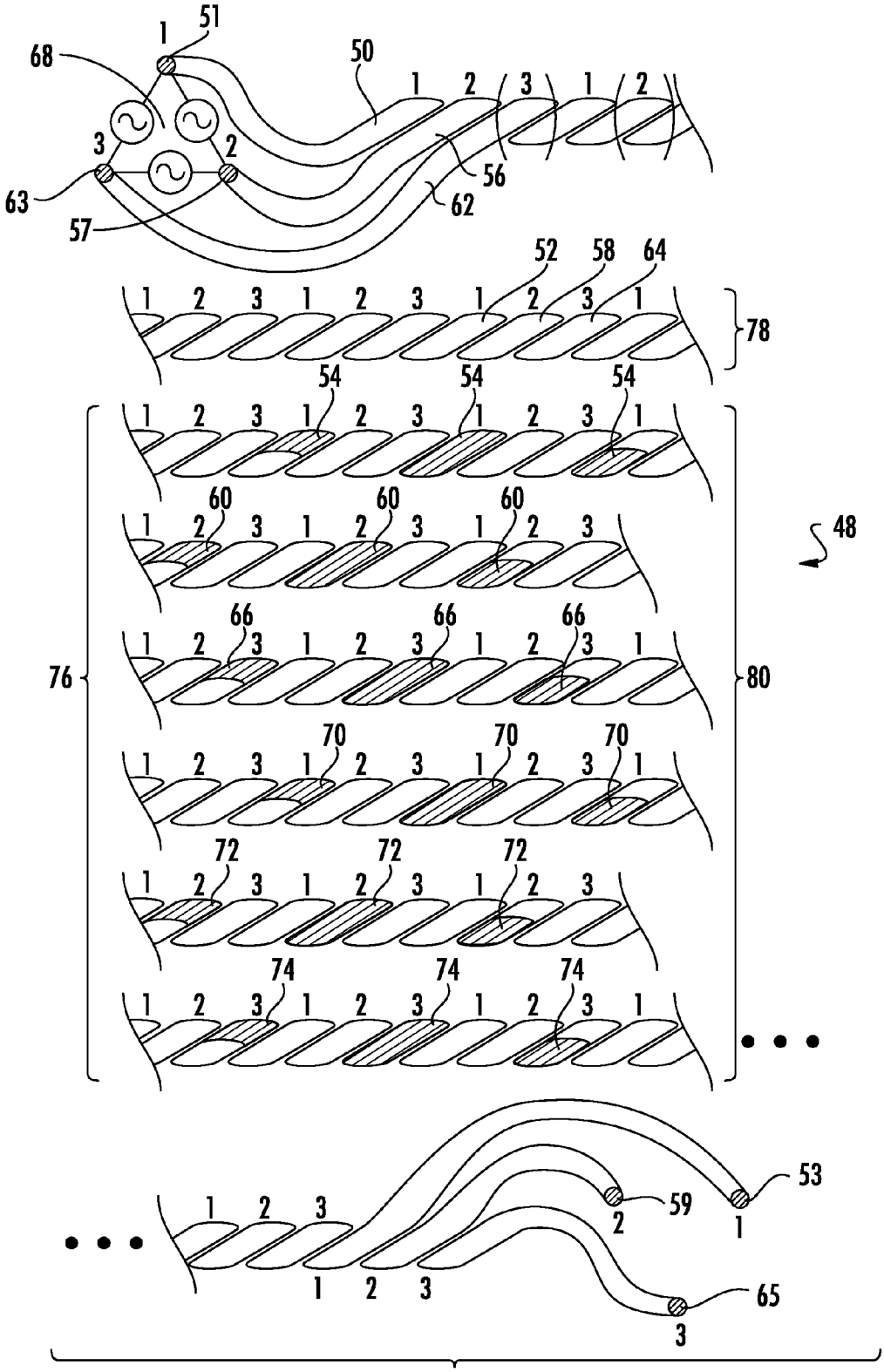
FIG. 6 is a diagrammatic elevation view of sections of an embodiment of an applicator.

In FIG. 6 another embodiment of the present invention is shown as an applicator 48. FIG. 6 shows a series of sections of the applicator 48. The sections shown do not need to be in any particular order or spaced as shown, and the applicator can contain any number of each section illustrated in any order, as will be explained below. The applicator 48 includes at least a first strand 50 having a first end 51, a second end 53, an insulated portion 52 and a bare portion 54; and a second strand 56 having a first end 57, a second end 59, an insulated portion 58 and a bare portion 60. The first strand 50 and second strand 56 are braided, twisted, or both braided and twisted together such that the bare portion of each strand (54,60) is adjacent to the insulated portion of the other strand (52,58).

The embodiment shown in FIG. 6 further illustrates that a third strand 62 can be included having a first end 63, a second end 65, an insulated portion 64, and a bare portion 66 where the third strand 62 is braided, twisted, or both braided and twisted together with the other strands (50,56) such that the bare portion 66 of the third strand 62 is adjacent to the insulated portions (52,58) of the other strands (50, 56). It is also contemplated that the applicator 48 can have additional strands that would be incorporated in the same manner as the third strand 62. Each strand (50,56,62) can include one or more individual conductors or wires, preferably many such conductors or wires for RF applications. FIG. 6 shows that the strands (50,56,62) are untwisted near the first ends (51,57,63) and second ends (53,59,65) of the applicator 48. This is done to better illustrate the way in which the strands (50,56,62) form the applicator 48, and it is not a limitation.

The embodiment in FIG. 6 shows a power source 68 connected to the first ends (51,57,63) of the strands (50,56,62). Different power sources may be used for different applications. A DC source or low frequency AC source may be used for resistive heating applications. A high frequency AC source may be used for dielectric heating applications. Of course, the power source 68 can be transmitting equipment that can provide any combination of types of power. When an AC source is used it can be a multiple phase source. The number of phases of the power source 68 optionally can be determined by the number of strands in the applicator 48. For example, the embodiment in FIG. 6 shows three strands (50, 56,62), and the power source 68 is three phase RF alternating current.

The embodiment in FIG. 6 also shows that the first strand 50 can have a second bare portion 70, the second strand 56 can have a second bare portion 72, and the third strand 62 can have a second bare portion 74. The strands (50,56,62) are braided, twisted, or both braided and twisted together such that the second bare portion 70 of the first strand 50 is adjacent to an insulated portion of the second and third strands (56,62); the second bare portion 72 of the second strand 56 is adjacent to an insulated portion of the first and third strands (50,62); and the second bare portion 74 of the third strand 62 is adjacent to an insulated portion of the first and second strands (50,56). FIG. 6 further illustrates that there can be any number of bare portions on the strands (50,56,62) as long as there is enough room along the length of the applicator 48. The additional bare portions optionally can be incorporated in the same way as the first bare portions (56,60,66) and second bare portions (70,72,74). It should be noted that the spacing between consecutive bare portions can be adjusted to reach the optimal RF penetration and heating depth for each particular application.

FIG. 6 shows that the pattern of sections 76 can repeat until the second ends (53,59,65) of the strands of the applicator 48 are reached. There are many other contemplated patterns of sections 76, and FIG. 6 is only a single embodiment. The applicator 48 can include any number of each type of section shown in FIG. 6, in any order. In this embodiment the applicator 48 is structured so that the bare portions alternate strands (50,56,62) along the length of the applicator 48 from the first ends (51,57,63) to the second ends (53,59,65) of the strands (50,56,62). This configuration promotes uniform heating along the length of the applicator 48 by offsetting the respective heating elements, but other configurations will work also.

In this embodiment the applicator 48 has a first portion (transmission portion) 78 that has no bare portions and a second portion (heating portion) 80 that has two or more bare portions. In FIG. 6 the transmission portion 78 conducts power to the heating portion 80 along the length of the applicator 48. However, these portions can be reversed, or there can be more than one of either or both the transmission portion 78 and heating portion 80 that are positioned along the applicator 48 to achieve the desired heating pattern.

The applicator 48 can be used in system 20 of FIG. 1. In that situation, it would be beneficial to have the transmission portion 78 run the length of the applicator bore 26 that extends through the overburden 34 to inhibit heating of the overburden 34. The heating portion 80 optionally could then run the length of the applicator bore 26 that extends through the formation 32, or be confined to some portion of that length.

Figure 7:
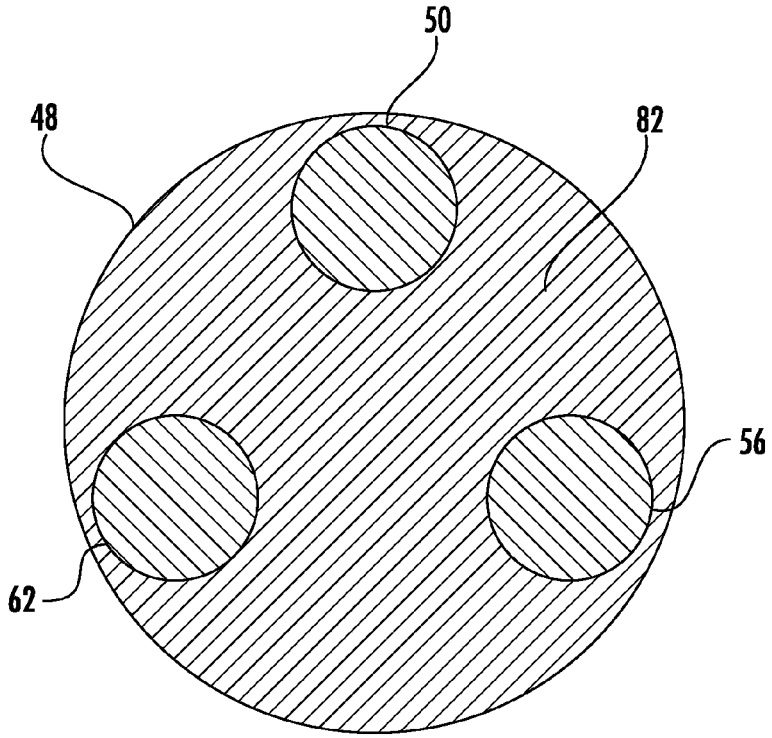
FIG. 7 is a cross sectional view of the applicator from FIG. 6 where the strands of the applicator are separated by a dielectric filler.

FIG. 7 shows a cross sectional view of the applicator 48. As shown, the strands (50,56,62) of the applicator 48, each of which can be a multi-wire strand, may be separated from each other by a dielectric filler 82. The dielectric filler can be jute, a polymer, or any other dielectric material. By separating the strands (50,56,62) with a dielectric filler 82, the conductor proximity effect along the length of the applicator 48 is limited. The dielectric filler 82 can be used in the transmission portion 78, the heating portion 80, or both.

Figure 8:
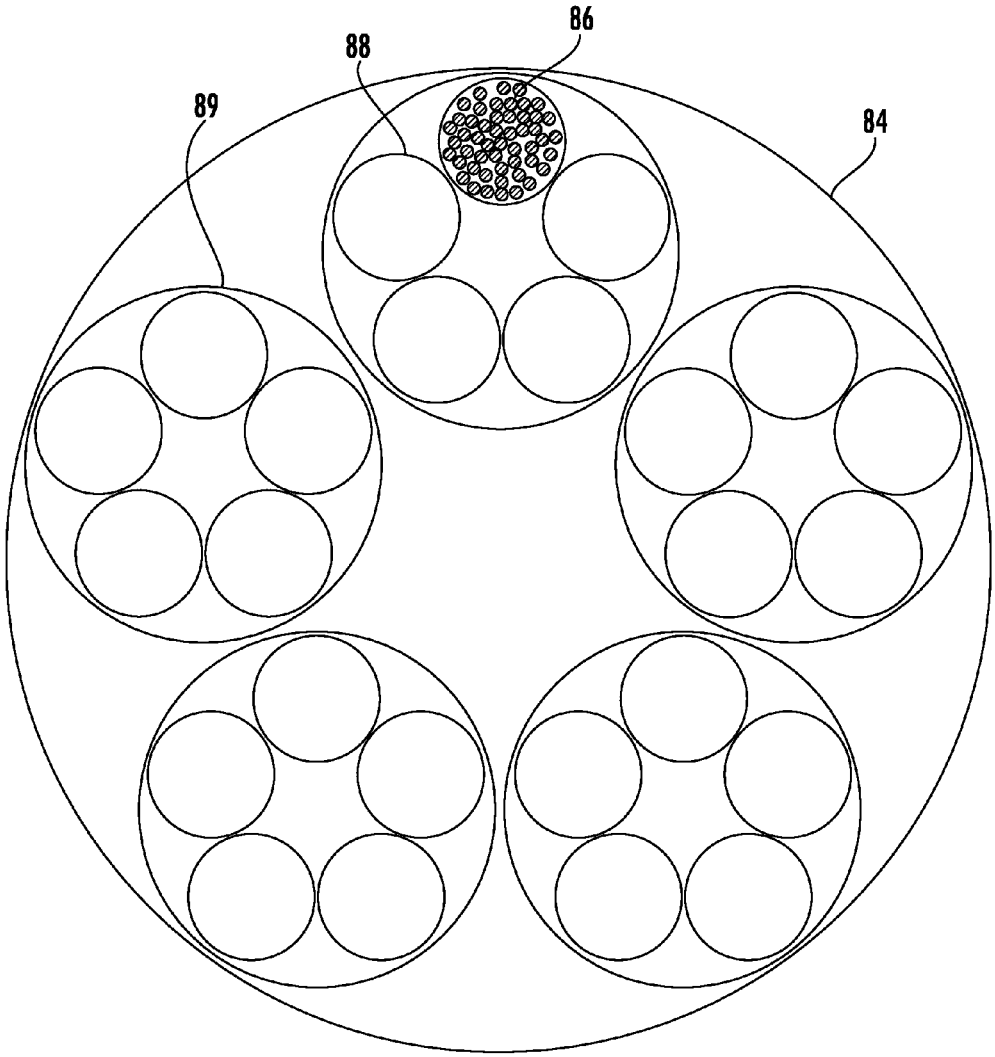
FIG. 8 is a cross sectional view of a strand of the applicator from FIG. 6 where each strand of the applicator is a Litz cable.

FIG. 8 shows a cross sectional view of an embodiment of a strand 84 of the applicator 48. As illustrated, the strand 84 can be a Litz cable. Any Litz cable/wire such as 84 can be used, but generally the Litz cable 84 will be composed of a plurality of wires 86 twisted into first bundles 88, the first bundles 88 being twisted together into second bundles 89, and then the second bundles 89 being twisted to form the Litz cable 84. A larger Litz cable 84 can be achieved by continuing to twist successive bundles together until the desired cable size is attained. The Litz cable 84 is usually made from copper or steel wires 86, but wires 86 made from other materials can also be used depending on how the applicator 48 is to be utilized. Litz conductors are especially beneficial when the wires 86 are steel to mitigate magnetic skin effect as well as the conductor skin effect.

Figure 9:
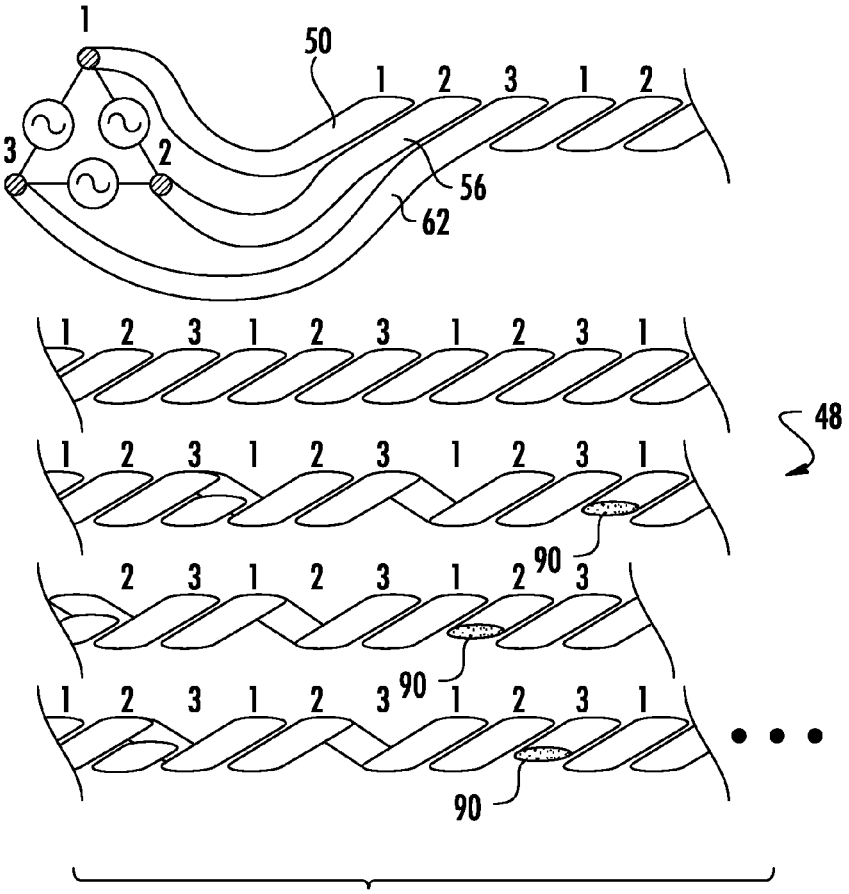
FIG. 9 is a diagrammatic elevation view of sections of an embodiment of an applicator where there are breaks in the strands.

FIG. 9 shows another embodiment of the applicator 48. This embodiment includes a first strand 50 having at least one break 90, a second strand 56 having at least one break 90, and a third strand 62 having at least one break 90. The strands (50,56,62) are braided, twisted, or both braided and twisted together such that none of the breaks 90 are adjacent to each other. When a high frequency power source 68 is applied to the applicator 48, the breaks 90 in the strands will create electric fields that will have a dielectric heating effect on the surrounding medium. Normally breaks 90 in the strands (50, 56,62) would interrupt the circuit; however, at higher frequencies the breaks 90 create a capacitive effect such that the power is transmitted from one break to another.

The applicator 48 operates on the same theories discussed above with respect to the applicator 22 from FIG. 1 with a few differences due to the bare portions (54,60,66,70,72,74, . . . ). The bare portions function as electrode contacts to the formation 32 which preferentially contains water or saltwater sufficient to provide electrical conduction between the bare portions of the applicator 22. When the RF transmitter source (24,68) applies DC or low AC frequencies, such as 60 Hz, the applied electrical currents heat the formation resistively by joule effect. At higher radio frequencies, the heating may also include displacement currents formed by the capacitance between the applicator 22 and the formation 32. Bitumen formations may have a high dielectric permittivity due to the water and bitumen film structures that form around the sand grains. The current distributions from the bare portions (54, 60,66,70,72,74, . . . ) overlap to improve heating uniformity along the applicator 22 when the RF transmitter source (24, 68) applies overlapping phases to the strands (51,57,63). Although a three phase system in shown in FIG. 6, it is contemplated that a two phase system can be used with two strands or a four phase system can be used with four strands and so forth.

Figure 10:
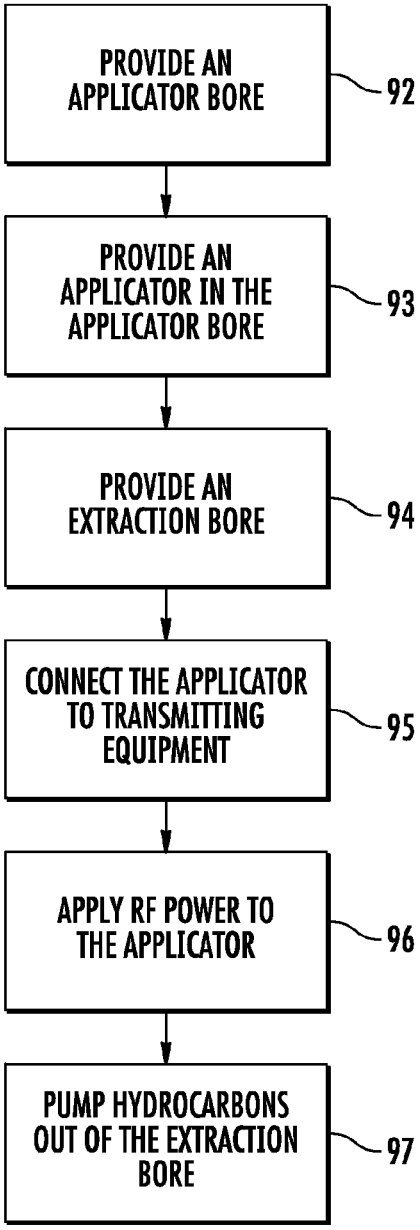
FIG. 10 is a flow diagram illustrating a method of heating a geological formation and extracting hydrocarbons.

In FIG. 10 another embodiment of the present invention is illustrated as a method for extracting hydrocarbons from a geological formation. At the step 92, an applicator bore that extends into the formation is provided. At the step 93, an applicator in the applicator bore is provided. At the step 94, an extraction bore positioned below the applicator bore is provided. At the step 95, the applicator is connected to RF transmitting equipment. At the step 96, RF power is applied to the applicator which then heats the formation through resistive or dielectric heating or otherwise and allows the hydrocarbons to flow. At the step 97, hydrocarbons are pumped out of the extraction bore.

At step 96, RF power is applied to the applicator by the transmitting equipment. The power source or transmitting equipment can apply DC power, low frequency AC power, or high frequency AC power. The source can be multiple phases as well. Two and three phase sources are prevalent but four, five, and six phase sources etc., can also be used if the transmitting equipment is capable of providing them. The transmitting equipment can also be configured to create anti-parallel current in the applicator. It may be preferable to raise the radio frequency of the RF transmitter source over time as ore is withdrawn from the formation. Raising the frequency can introduce the radiation of radio waves (far fields) that provide a rapid thermal gradient at the melt faces of a bitumen well cavity. Raising the frequency also increases the electrical load impedance of the ore which is referred back to the RF transmitter by the applicator thereby reducing resistive losses in the applicator. Reducing the frequency increases the penetration of RF heating longitudinally along the applicator. The radial penetration of the electromagnetic heating is mostly a function of the conductivity of the formation for near field heating and a function of the frequency that is used for far field heating.

Although preferred embodiments have been described using specific terms, devices, and methods, such description is for illustrative purposes only. The words used are words of description rather than of limitation. It is to be understood that changes and variations can be made by those of ordinary skill in the art without departing from the spirit or the scope of the present invention, which is set forth in the following claims. In addition, it should be understood that aspects of the various embodiments can be interchanged either in whole or in part. Therefore, the spirit and scope of the appended claims should not be limited to the description of the preferred versions contained herein.

The invention claimed is:

1. An apparatus for heating hydrocarbon resources in a subterranean formation having a bore therein, the apparatus comprising:

a radio frequency (RF) source; and a Litz bundle RF applicator configured to be positioned in the bore and coupled to said RF source, said Litz bundle RF applicator comprising:

a first strand comprising at least one wire having a first end, a second end, an insulated portion, and a first bare portion, and a second strand comprising at least one wire having a first end, a second end, an insulated portion, and a first bare portion, the first bare portion of said first strand being intertwined with and adjacent the insulated portion of said second strand, the first bare portion of said second strand being intertwined with and adjacent the insulated portion of said first strand.

2. The apparatus of claim 1, wherein the first bare portion of said second strand being intertwined with the insulated portion of said first strand comprises the first bare portion of said second strand being twisted with the insulated portion of said first strand.

3. The apparatus of claim 1, wherein the first bare portion of said second strand being intertwined with the insulated portion of said first strand comprises the first bare portion of said second strand being braided with the insulated portion of said first strand.

4. The apparatus of claim 1, wherein said Litz bundle RF applicator further comprises:

a third strand comprising at least one wire having a first end, a second end, an insulated portion, and a first bare portion;

the first bare portion of said third strand being intertwined with and adjacent the insulated portions of said first and second strands.

5. The apparatus of claim 1, wherein said first strand comprises a second bare portion adjacent and intertwined with the insulated portion of said second strand; and wherein the first bare portion of said second strand is between the first and second bare portions of said first strand.

6. The apparatus of claim 1, wherein said first and second strands each comprises:

a further bare portion; and a further insulated portion;

each of the first bare portion and the further bare portion of said first strand being adjacent and intertwined with at least one of the insulated portion and the further insulated portion of said second strand;

each of the first bare portion and the further bare portion of said second strand being adjacent and intertwined with at least one of the insulated portion and the further insulated portion of said first strand.

7. The apparatus of claim 6, wherein the first bare portion and the further bare portion of said first and second strands alternate along a length of said Litz bundle RF applicator from the first ends to the second ends.

8. The apparatus of claim 1, wherein said Litz bundle RF applicator further comprises a dielectric filler separating said first and second strands.

9. The apparatus of claim 1, wherein each of said first and second strands has at least one break therein.

10. The apparatus of claim 1, wherein said first and second strands are electrically isolated from each other.

11. A Litz bundle RF applicator operable for heating hydrocarbon resources in a subterranean formation having a bore therein, the Litz bundle RF applicator comprising:

a first strand comprising at least one wire having a first end, a second end, an insulated portion, and a first bare portion; and a second strand comprising at least one wire having a first end, a second end, an insulated portion, and a first bare portion;

the first bare portion of said first strand being intertwined with and adjacent the insulated portion of said second strand;

the first bare portion of said second strand being intertwined with and adjacent the insulated portion of said first strand.

12. The Litz bundle RF applicator of claim 11, further comprising:

a third strand comprising at least one wire having a first end, a second end, an insulated portion, and a first bare portion;

the first bare portion of said third strand being intertwined with and adjacent the insulated portions of said first and second strands.

13. The Litz bundle RF applicator of claim 11, wherein said first strand comprises a second bare portion adjacent and intertwined with the insulated portion of said second strand; and wherein the first bare portion of said second strand is between the first and second bare portions of said first strand.

14. The Litz bundle RF applicator of claim 11, wherein said first and second strands each comprise:

a further bare portion; and a further insulated portion;

each of the first bare portion and the further bare portion of said first strand being adjacent and intertwined with at least one of the insulated portion and the further insulated portion of said second strand;

each of the first bare portion and the further bare portion of said second strand being adjacent and intertwined with at least one of the insulated portion and the further insulated portion of said first strand.

15. The Litz bundle RF applicator of claim 14, wherein the first bare portion and the further bare portion of said first and second strands alternate along a length of said Litz bundle RF applicator from the first ends to the second ends.

16. The Litz bundle RF applicator of claim 11, further comprising a dielectric filler separating said first and second strands.

17. A method of heating hydrocarbon resources in a subterranean formation having a bore therein, the method comprising:

forming a Litz bundle applicator by intertwining a first strand comprising at least one wire having a first end, a second end, an insulated portion, and a first bare portion with a second strand comprising at least one wire having a first end, a second end, an insulated portion, and a first bare portion with the first bare portion of the first strand being intertwined with and adjacent the insulated portion of the second strand, and the first bare portion of the second strand being intertwined with and adjacent the insulated portion of the first strand; positioning the Litz bundle applicator in the bore; and supplying radio frequency (RF) power from an RF source to the Litz bundle RF applicator.

18. The method of claim 17, wherein supplying RF power to the Litz bundle RF applicator further comprises:

supplying RF power to a third strand comprising at least one wire having a first end, a second end, an insulated portion, and a first bare portion;

the first bare portion of the third strand being intertwined with and adjacent the insulated portions of the first and second strands.

19. The method of claim 17, further comprising increasing a frequency of the RF source while supplying RF power to the Litz bundle RF applicator.

* * * * *